US010830043B2

(12) United States Patent
Riechers

(10) Patent No.: US 10,830,043 B2
(45) Date of Patent: Nov. 10, 2020

(54) PROTECTIVE ELEMENT WITH DRAINAGE, FOR CONNECTING TO A CONCRETE ELEMENT OF A TUNNEL EXTENSION

(71) Applicant: HERRENKNECHT AG, Schwanau (DE)

(72) Inventor: Jörg Riechers, Zell am Harmersbach (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 15/742,851

(22) PCT Filed: Jul. 15, 2016

(86) PCT No.: PCT/EP2016/001245
§ 371 (c)(1),
(2) Date: Jun. 6, 2019

(87) PCT Pub. No.: WO2017/008913
PCT Pub. Date: Jan. 19, 2017

(65) Prior Publication Data

US 2019/0309625 A1 Oct. 10, 2019

(30) Foreign Application Priority Data

Jul. 16, 2015 (DE) ..... 10 2015 009 063

(51) Int. Cl.
*E21D 9/06* (2006.01)
*E21D 11/08* (2006.01)
(Continued)

(52) U.S. Cl.
CPC .... *E21D 9/0607* (2013.01); *E04B 2002/0265* (2013.01); *E04B 2002/0286* (2013.01); *E21D 11/08* (2013.01); *E21D 11/38* (2013.01)

(58) Field of Classification Search
CPC ..... E21D 9/0607; E21D 11/38; E04B 2002/0286
(Continued)

(56) References Cited

U.S. PATENT DOCUMENTS 4,182,580 A * 1/1980 Hieda ..... E02B 11/005 138/103
4,585,371 A * 4/1986 Jones-Hinton ..... E03F 3/06 405/150.1
(Continued)

FOREIGN PATENT DOCUMENTS

CA 2786640 A1 12/2010
JP 2004132002 A 4/2004
(Continued)

*Primary Examiner* — Tara Mayo-Pinnock
(74) *Attorney, Agent, or Firm* — Mark Rodgers

(57) ABSTRACT

The invention relates to a protective element for connecting to a concrete element of a tunnel extension, which has a protective section having a first side facing the concrete element (10), on which first side at least one connecting element (17) is provided for establishing a retaining connection of the protective section to the concrete element (10), wherein the protective section is made from at least one plastic material, characterized in that the protective section (20) has at least one drainage element (40) through which a fluid can pass from the first side of the protective section (20) to the opposite side of the protective section (20) facing away from the concrete element (10).

23 Claims, 13 Drawing Sheets

Figure 1:
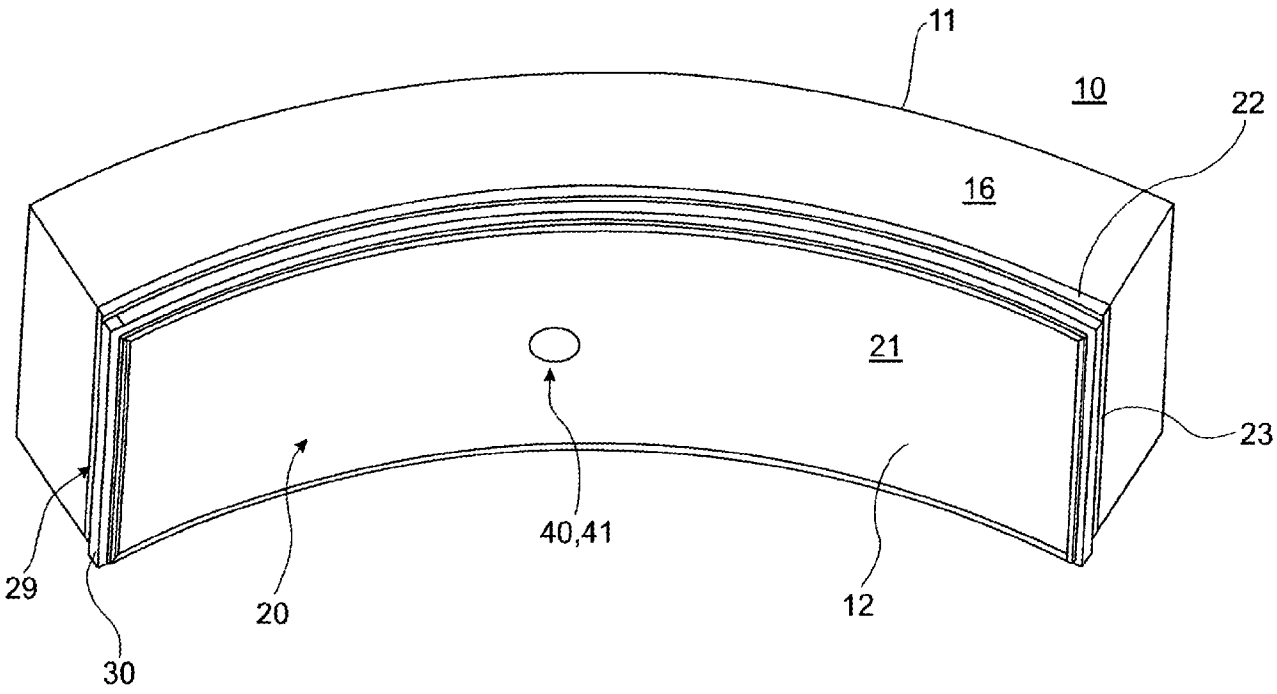

(51) Int. Cl.
*E21D 11/38* (2006.01)
*E04B 2/02* (2006.01)

(58) Field of Classification Search
USPC ..... 405/134, 135, 146, 147, 151, 152, 153; 428/131
See application file for complete search history.

(56) References Cited

U.S. PATENT DOCUMENTS

| | | | | |
|---|---|---|---|---|
| 6,302,621 | B1 * | 10/2001 | Miya | E02B 11/005 405/127 |
| 7,722,293 | B2 * | 5/2010 | Kruse | E02D 17/04 405/133 |
| 7,909,535 | B2 * | 3/2011 | Samara | E03B 3/16 138/140 |
| 9,388,691 | B2 | 7/2016 | Peters | |
| 2012/0301224 | A1 * | 11/2012 | Peters | E21D 11/08 405/152 |

FOREIGN PATENT DOCUMENTS

| | | | |
|---|---|---|---|
| JP | 2009180019 | A | 8/2009 |
| RU | 2386754 | C2 | 4/2010 |
| WO | 2005024183 | A1 | 3/2005 |

* cited by examiner

PROTECTIVE ELEMENT WITH DRAINAGE, FOR CONNECTING TO A CONCRETE ELEMENT OF A TUNNEL EXTENSION

The invention relates to a protective element for connecting to a concrete element of a tunnel lining, which protective element has a protective section which has a first side which faces the concrete element and on which at least one connecting element for establishing a retentive connection of the protective section to the concrete element is provided, the protective section consisting of at least one plastic.

Concrete elements and/or protective elements of this type are known, inter alia, from WO 2005/024183 A1 and from WO 2011/085734 A1. An alternative embodiment is known from JP 2004132002.

Concrete elements of this type are also known as "segments" in technical terminology and are used, for example, in the case of machine tunnel construction by means of shield drive. Here, for example, tunnel boring machines are used which comprise a drilling head, behind which a cylindrical shield with a shield skin and a shield tail is arranged. The shield has a smaller external diameter than the drilling head, with the result that there is no direct contact between the tunnel wall and the shield. If the tunnel boring machine is advanced a certain distance, the concrete elements are positioned in the shield tail at the shield edge. They are pressed counter to the advancing direction onto the adjacent, most recently attached concrete elements and are connected to the latter. A plurality of concrete elements together form a ring over the entire circumference of the tunnel.

The gap between the ring and the tunnel wall is possibly filled with mortar, for example in order to prevent settlements. For this purpose, WO 2005/0241863 A1 discloses an injection hole in the center of the concrete element, which injection hole is configured as a hole which connects the outer surface of the concrete element to the inner surface of the concrete element. After the individual concrete element is positioned and connected to its adjacent concrete elements, mortar is injected between the concrete element and the tunnel wall via the injection hole. In this way, settlements in the ground which surrounds the concrete element are prevented. In addition, the concrete element can be moved and positioned by means of the injection hole by way of a suitable tool being engaged into it.

This type of tunnel construction is also used, inter alia, for the construction of sewers, in particular of relatively large collecting mains. Here, as is also the case in other possible uses, increased requirements are made of the sealed nature of the lining of the tunnel. The inner side of the segments is sealed by way of a lining, with the result that no sewage and no gases which rise from the sewage can pass via the tunnel walls into the concrete and can damage the latter (corrosion).

In the case of a tunnel which is lined by way of concrete elements according to WO 2005/0241863 A1 or WO 2011/085734 A1, the protective layer comprising protective elements protects the concrete of the concrete element against the action of aggressive (for example, corrosive) gases or liquids. Together with seals, the protective elements of the concrete elements of the lining therefore seal the tunnel from the inside. The concrete element is produced in a prefabricated manner with the protective element, as a result of which sealing of the lining as a separate work step in tunnel construction, for example the welding of the joints between the protective elements/protective layers of adjacent concrete elements, is dispensed with.

WO 2005/024183 A1, WO 2011/085734 A1 and likewise JP2004132002 have disclosed that the segments which are used for the tunnel lining are prefabricated, and that a lining is already arranged on the inner side of the segments during the production of the segments, by way of which lining sealing of the tunnel wall against water, sewage and gases takes place in the assembled state of the individual segments to form rings.

Here, a protective layer is provided on the concrete element, which protective layer covers an inner surface of the segment, which inner surface lies opposite a convex outer surface. Said protective layer consists of glass fiber reinforced plastic or polyethylene (PE) according to WO 2005/024183 A1, of polydicyclopentadiene (pDCPD) according to WO 2011/085734 A1, or of a synthetic resin according to JP2004132002 and here, in particular, of polyethylene (PE), polypropylene (PP), PVC, polyester or vinyl ester, and is anchored fixedly in the concrete by means of mechanical anchoring, with the result that an inseparable connection of the protective layer to the concrete is produced. Here, the protective layer is designed in such a way that only the inner side of the segment element is covered (JP2004132002) or else a side face of the concrete element is partially likewise enclosed (WO 2005/024183 A1, WO 2011/085734 A1).

According to WO 2005/024183 A1 and WO 2011/085734 A1, a seal which projects beyond the protective layer is subsequently provided on the side face. The seal is produced from an elastic material, with the result that the joints between the adjacent concrete elements are closed by way of the seal during assembly of the individual segments to form the tunnel lining. As an alternative, the closure of the joints can take place by way of welding of the individual protective layers which are provided on the inner side of the concrete elements.

According to WO 2005/024183 A1, the concrete element itself is produced by means of a formwork. A protective layer is placed into the formwork onto the formwork bottom. Furthermore, if provided, protective layer elements are likewise placed onto the side walls of the formwork. Furthermore, if provided, the formwork has a cutout, into which the seal is inserted. Subsequently, the concrete is introduced into the formwork in conjunction with reinforcement. After hardening of the concrete, the segment is used as a tunnel lining.

It has resulted in practice that leaks can always occur in the transition between the protective layer and the seal according to WO 2005/024183 A1 if sufficient care has not been taken during the production of the concrete element during the insertion of the seal into the formwork and/or during the arrangement of the seal in relation to the protective layer. To counteract this, WO 2011/085734 A1 proposes that the protective element is produced from an injection moldable plastic, and that a single-piece connection is provided between the seal and the protective element by the seal being connected to the protective element during the production of said protective element by being injection molded around it.

If, for example, there is groundwater in the region of the tunnel, there is the risk that said groundwater is under pressure or a corresponding pressure arises according to the depth of the tunnel. If there are cracks in the concrete and/or the water penetrates through the concrete, said water is present on the inner side of the protective layer/the protective elements, with the result that said protective layers/said protective elements is/are pressurized and has/have to be of corresponding dimensions in order to counteract a failure of the protective layer.

This occurred, in particular, in the case of tunnels with segments according to WO 2005/024183 A1, in which the anchorages were released from the concrete. To counteract this, WO 2011/085734 A1 provided different dimensioning of the anchors. This is secure, but possibly leads to an increased complexity during the production of the protective elements and/or the finished concrete elements.

If the protective elements are welded to one another, which usually takes place by hand, a corresponding quality of the welded seams has to be ensured.

In the case of a double-shell construction, in which an inner shell is applied on site to the segments, the entire ring is possibly not lined with a protective layer, but rather the protective layer is cut out in the bed region, in that region which does not dry out. The prevailing water can then flow out toward the bed on the side which faces toward the concrete elements, and can then enter into the tunnel there and can flow out via said tunnel. This is possible if said region does not dry out, with the result that no corrosion of the concrete is produced. A construction of this type is not possible if the effluents per se must not be diluted or if the effluents per se are already so aggressive that the concrete is impaired.

It is an object of the invention to provide a protective element by way of which corrosion of the concrete as a result of gases and liquids can be reliably avoided, and detaching of the protective element from the concrete is avoided at the same time.

With regard to the protective layer element, the object according to the invention is achieved by virtue of the fact that the protective section has at least one drainage element, through which a liquid can pass from the first side of the protective section toward the opposite side of the protective section which faces away from the concrete element.

It has surprisingly arisen during an attempt to improve the above-described protective element that it is possible, instead of reinforcing the anchorage of the protective element with respect to the concrete element, to instead discharge the prevailing groundwater in a targeted manner and, as a result, to prevent pressure-induced detachment and, at the same time, to ensure the impermeability of the protective layer with regard to possible corrosion of the concrete. It has been assumed up to now that it will not be possible that groundwater which penetrates the concrete from the outside as far as the protective element can be discharged in a targeted manner. However, regions are formed in extensive sections between the protective element and the concrete, which regions are not connected fixedly to the concrete, and through which regions the groundwater can flow, in particular toward at least one drainage element which is provided.

A further teaching of the invention provides that the drainage element has at least one opening in the protective element. A further teaching of the invention provides that the drainage element has a closure element and preferably a receptacle for a closure element for closing the drainage element with respect to the opposite side of the protective element, preferably for closing the opening. In this way, it becomes possible in a simple way to ensure sufficient security against corrosion and, at the same time, to avoid a detachment of the protective elements.

A further teaching of the invention provides that the closure element is arranged in the opening in a prestressed manner, a spring element or an elastic element preferably being provided for producing the prestress. Prestressing can ensure that the drainage takes place only if defined limit pressures are reached, from which there is a critical value with regard to the anchorage of the protective element in the concrete.

A further teaching of the invention provides that the drainage element has a hollow body, preferably in the form of a sleeve, in a manner which corresponds to the opening. A further teaching of the invention provides that the hollow body is an erector dowel. The provision of a hollow body ensures that sufficient discharge of the groundwater in the region of the protective element is ensured. A further teaching of the invention provides that at least one hollow body opening is provided in a wall of the hollow body, through which hollow body opening the liquid can pass from the first side into the sleeve. A further teaching of the invention provides that a closure body is provided in and/or in front of the at least one hollow body opening, which closure body is preferably designed in such a way that the hollow body opening can be opened after a limit pressure is exceeded. This can also be a diaphragm.

A further teaching of the invention provides that the protective section has at least one bottom section or has at least one bottom section and at least one wall section. It becomes possible in this way to achieve a particularly high sealing action of the protective element in conjunction with the concrete element.

A further teaching of the invention provides that the protective element has at least one seal which is connected in one piece to the protective section, the connection being gas-tight and liquid-tight.

A further teaching of the invention provides that the at least one drainage element is provided on the at least one bottom section and/or on the at least one wall section.

A further teaching of the invention provides that the single-piece connection of the seal to the protective section is produced by way of injection molding with the at least one plastic. It becomes possible as a result to limit the injection molding substantially to the direct connection of the bottom section to the seal. A liquid-tight and gas-tight connection is produced in a particularly simple way as a result of the single-piece connection of the seal and the connecting elements to the protective section. The injection molding can ensure that the protective elements are produced with a consistently high quality, with the result that, in relation to the finished concrete element, the protective action of the protective element is particularly high and of consistently high quality, independently of the production process of the concrete element. Here, the protective element is formed in such a way that, in relation to the seal, an enclosure of the seal material with the injection molding material is provided, which enclosure is provided at least on three sides.

A further teaching of the invention provides that the bottom section has at least one region in the form of a second made from at least one plastic, that the second section consists substantially of a film, a plate or a web which is preferably connected to connecting elements, and/or that the second section is formed from a further plastic. It is possible as a result to connect at least one prepared section of the protective element to the injection moldable plastic in such a way that a sufficient impermeability of the protective element can be achieved. At the same time, the production costs of the protective element can be lowered in a simple way as a result, since it becomes possible firstly to reduce the injection molding quantity and, as a result, to simplify the production and the injection mold.

Here, injection molding is understood to mean all methods which can be included in injection molding, that is to say methods, in which one or more thermoplastics/thermosets/ elastomers, for example as polymers or else monomers, are introduced directly into a mold on their own, individually, one after another or at the same time (for example, overmolding or multiple-component injection molding), or in which monomers are processed which only become polymers in the injection mold (for example, reaction overmolding).

A further teaching of the invention provides that the connecting element is an anchor structure, a honeycomb structure, a web, a pin and/or a panel element with openings. A further teaching of the invention provides that the connecting element is projections which preferably consist of the same plastic as the bottom section and/or wall section. Furthermore, it is advantageous that the protective section is connected in one piece to the at least one connecting element, the single-piece connection preferably being produced by way of injection molding of the plastic. Panel elements, in particular, such as honeycomb structures or panel sections with continuous openings, permit particularly satisfactory anchorage of the protective element to the concrete element over the entire area of the protective element. The additional provision of pins or the like which possibly reach further into the concrete of the concrete element can achieve an increased punctiform retention force increase.

In this context, a further teaching of the invention provides that, furthermore, a roof element is also provided, with the result that a hollow body is produced, into which hollow body the concrete and, possibly already during the injection molding, reinforcement are then subsequently introduced. This is advantageous, in particular, if the concrete element also has to be protected on its outer sides against aggressive bodies of water in mountain regions.

A further teaching of the invention provides that the plastic is polydicyclopentadiene (pDCPD), preferably in a highly temperature-resistant form, or a resin, reinforcing elements, such as glass fibers, possibly being added to the synthetic resin. A high product speed can be achieved by way of said plastic on account of the rapid processing properties. At the same time, there is a particularly high resistance during use. A further teaching of the invention provides that the plastic of the panel element is a thermoplastic, preferably PE. These are particularly inexpensive plastics. Components made from said plastics, such as plates, webs or films, can be produced directly on site in a decentralized manner, with the result that considerable transport expenditure and possibly also storage expenditure for the finished products are dispensed with.

With regard to the concrete element for producing a tunnel lining, the teaching of the invention provides that an above-described protective element is used. This is then a concrete element for producing a tunnel lining with a convex outer surface and an opposite inner surface, a protective element being connected via at least one connecting element to the inner surface, characterized in that the protective element is an above-described protective element.

Figure 2:
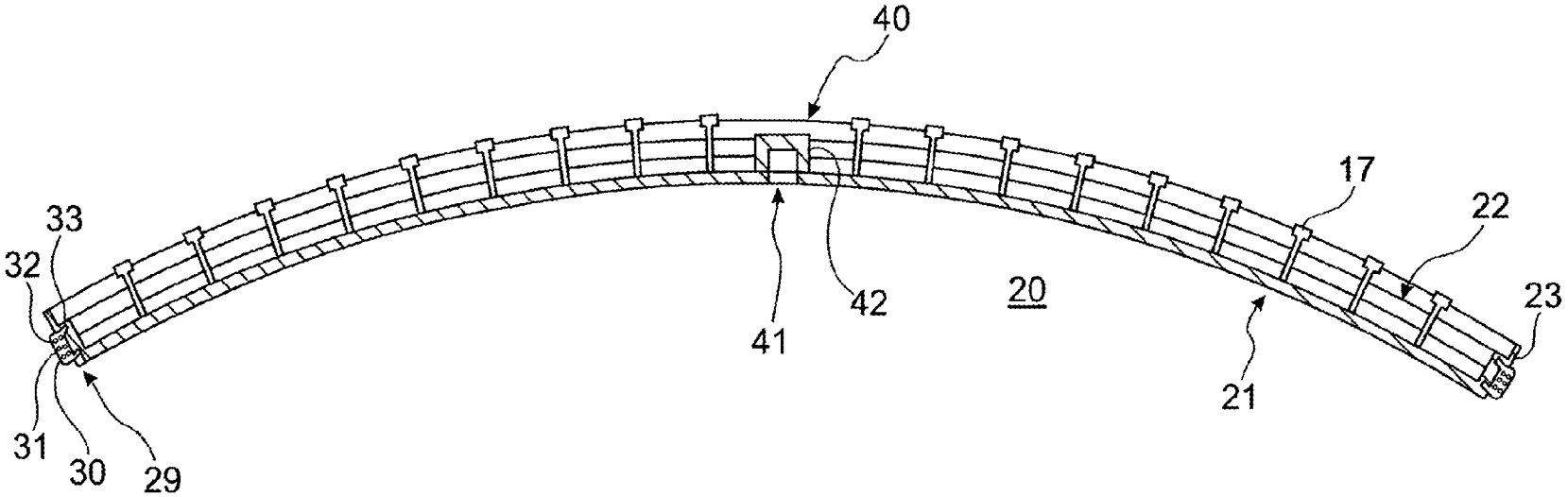
Figure 3A:
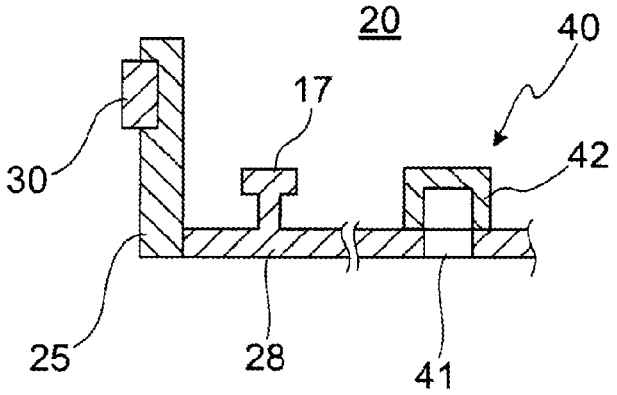
Figure 3B:
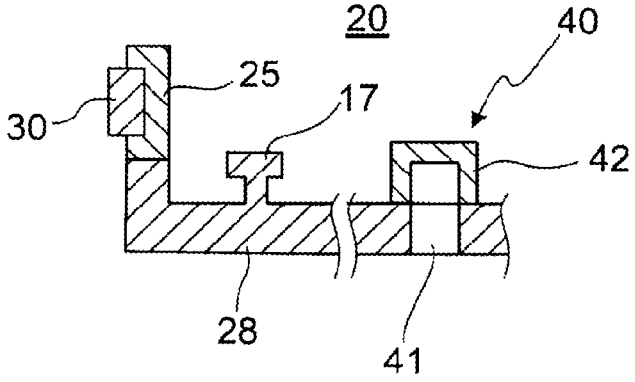
Figure 3C:
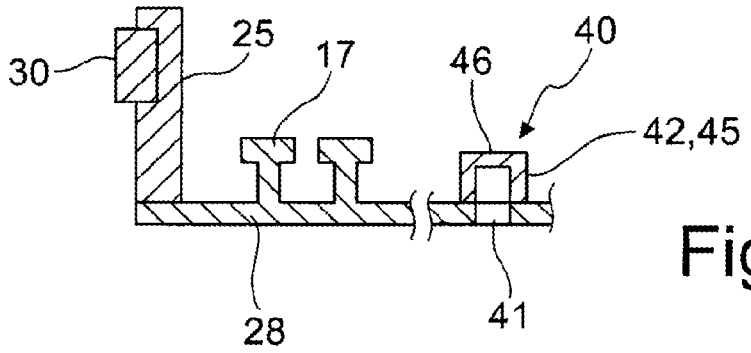
Figure 3D:
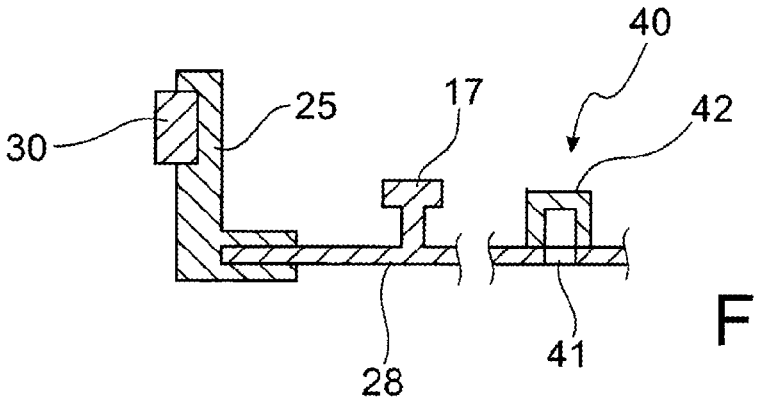
Figure 4:
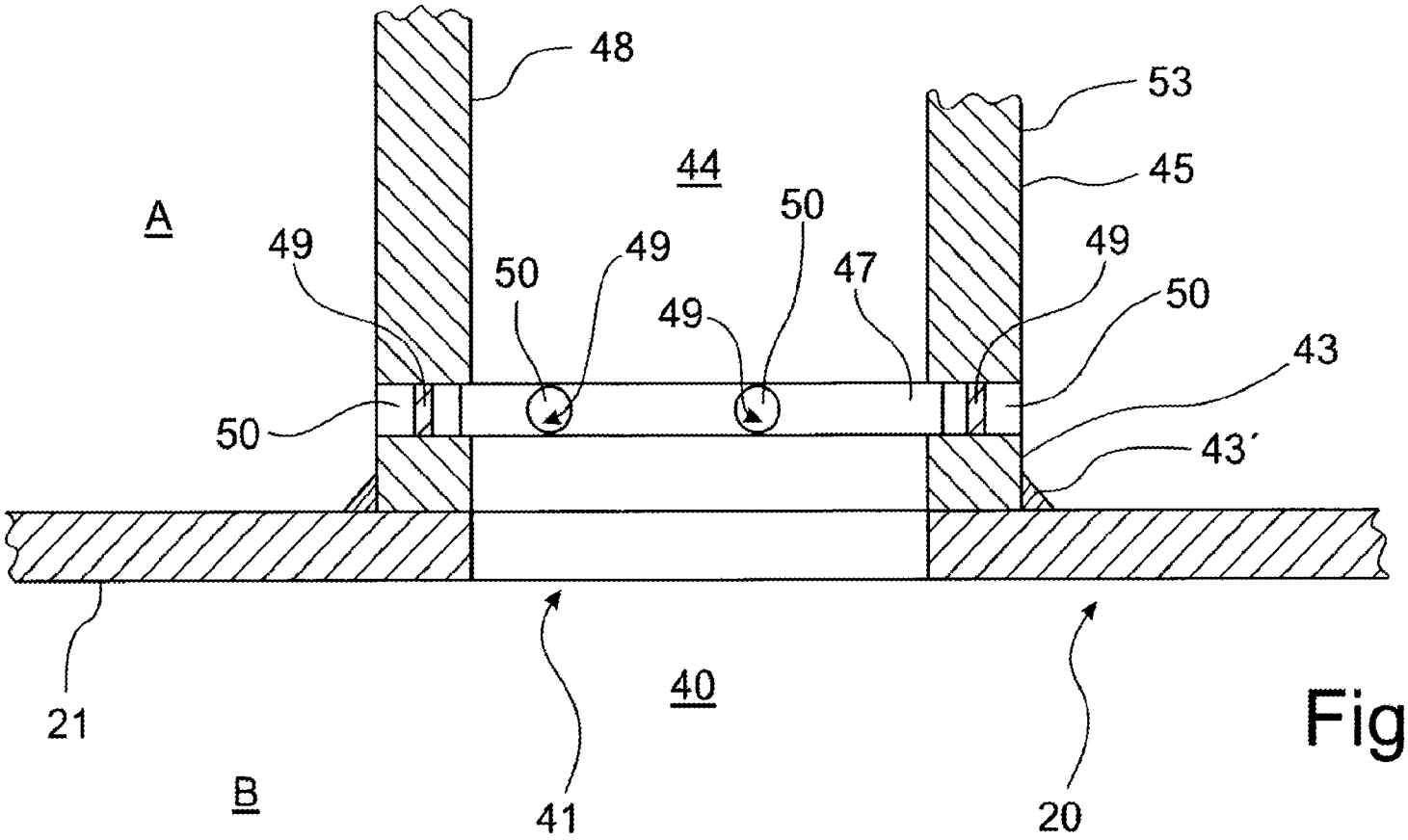
Figure 5:
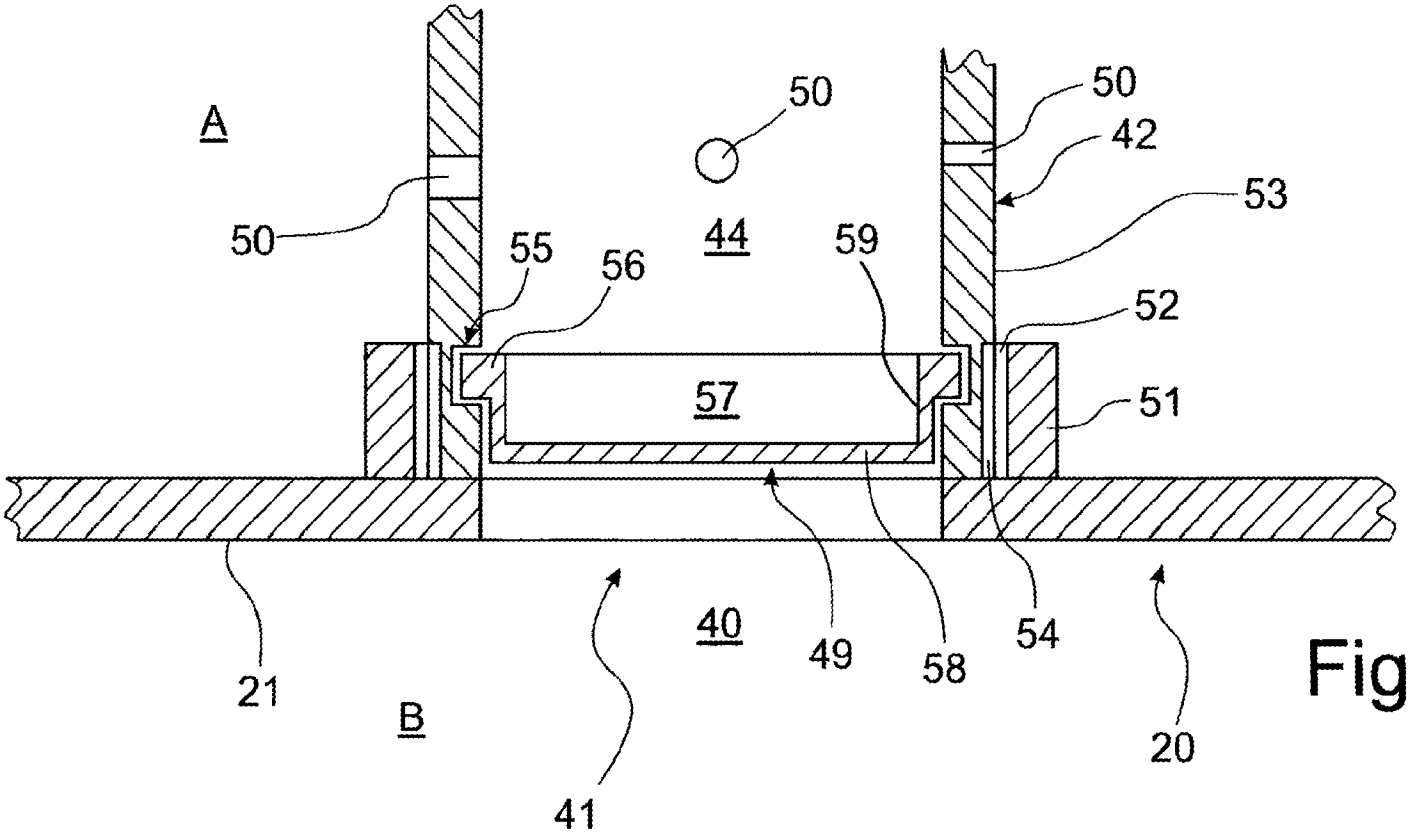
Figure 6A:
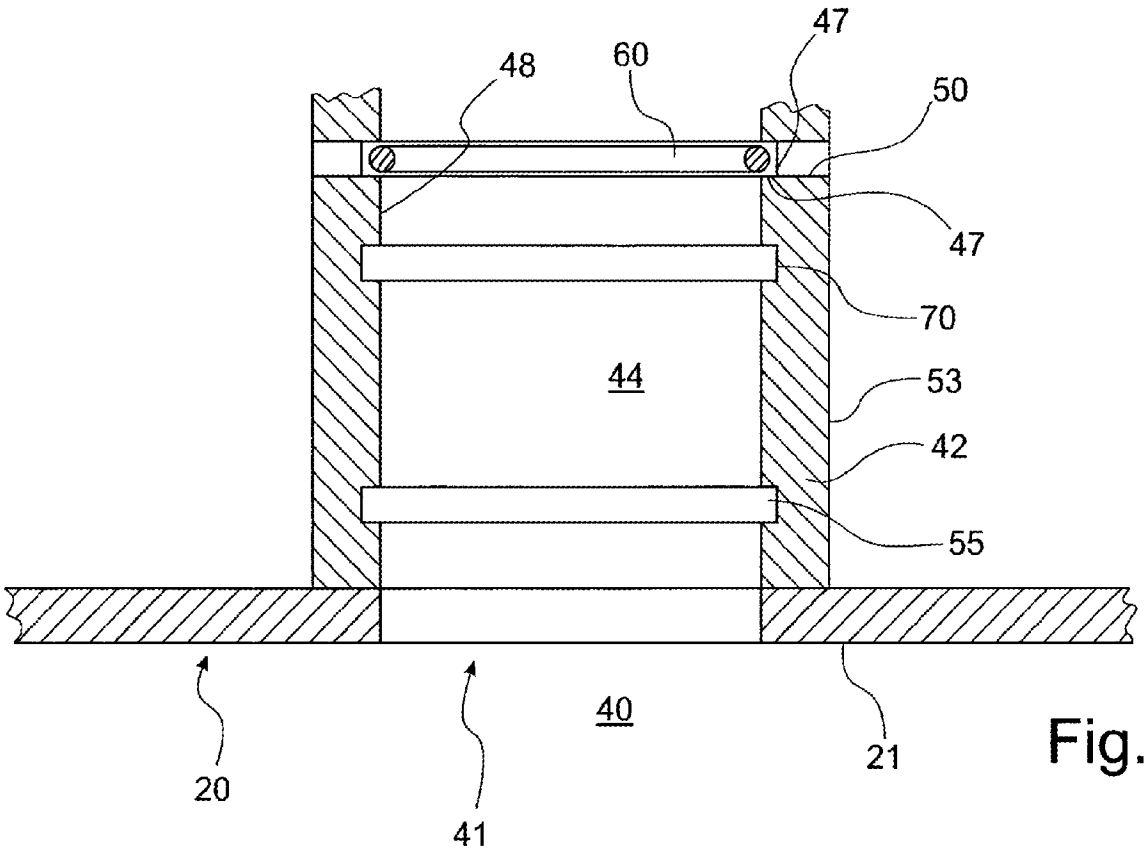
Figure 6C:
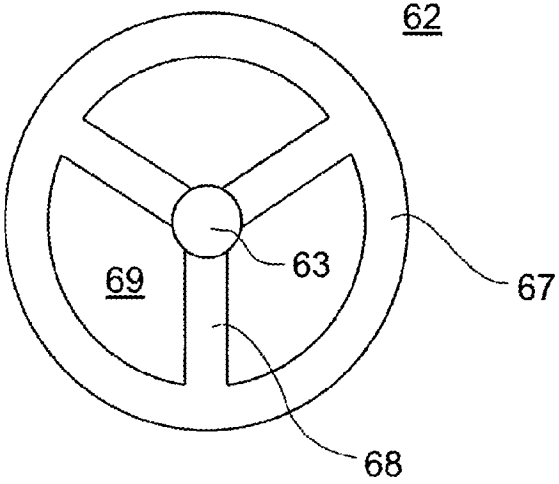
Figure 6B:
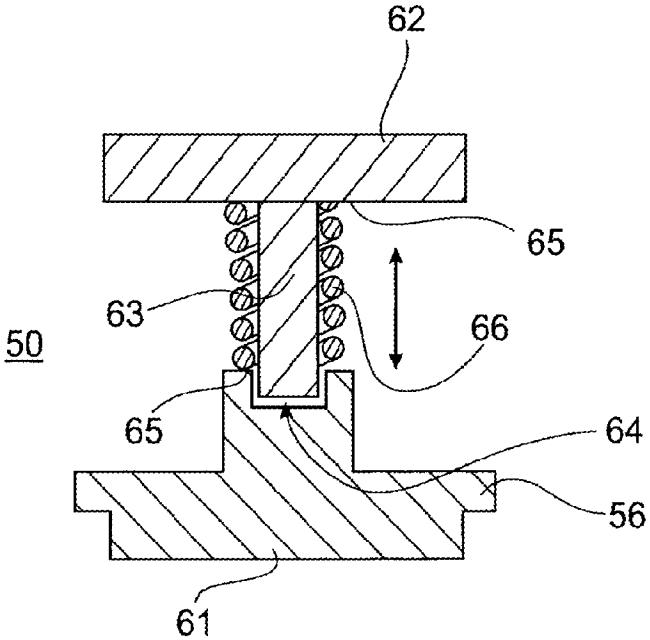
Figure 6D:
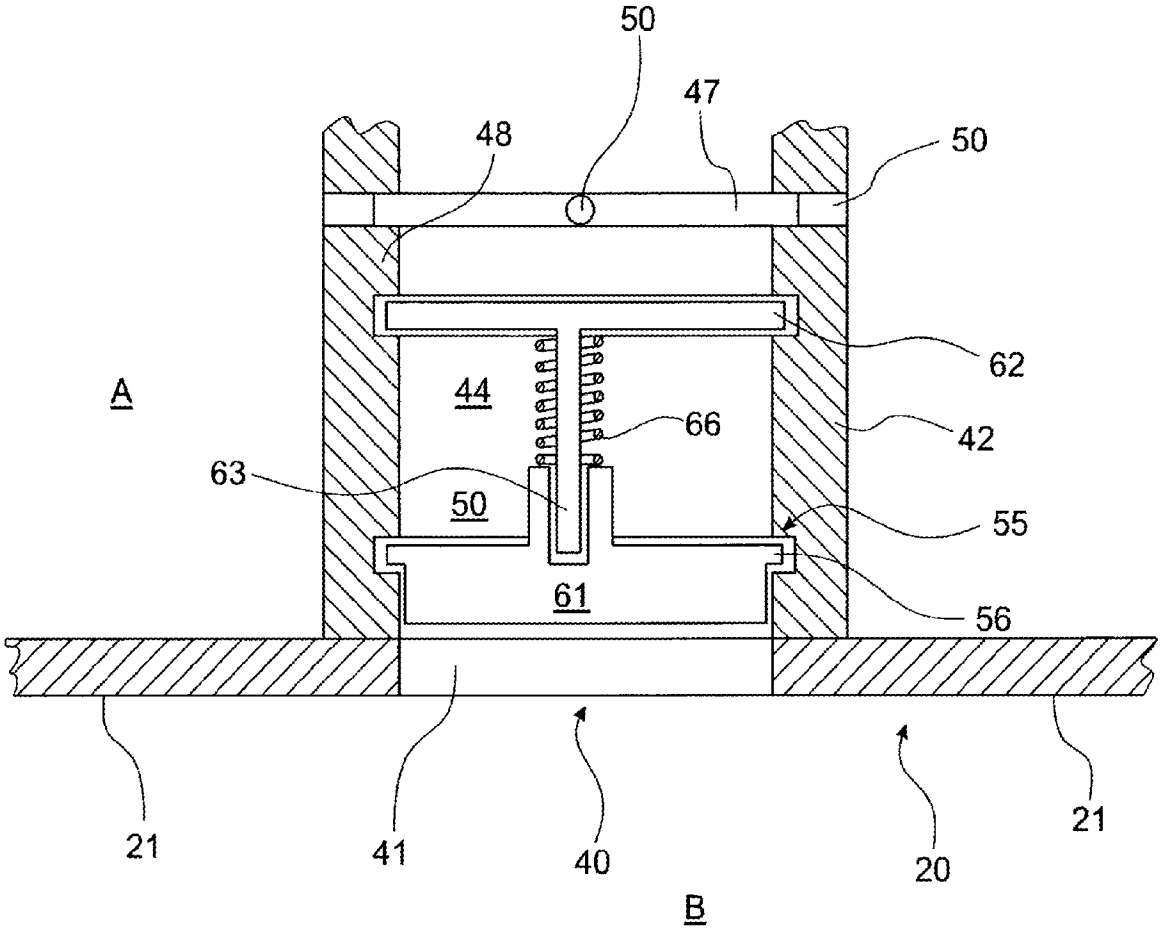
Figure 6E:
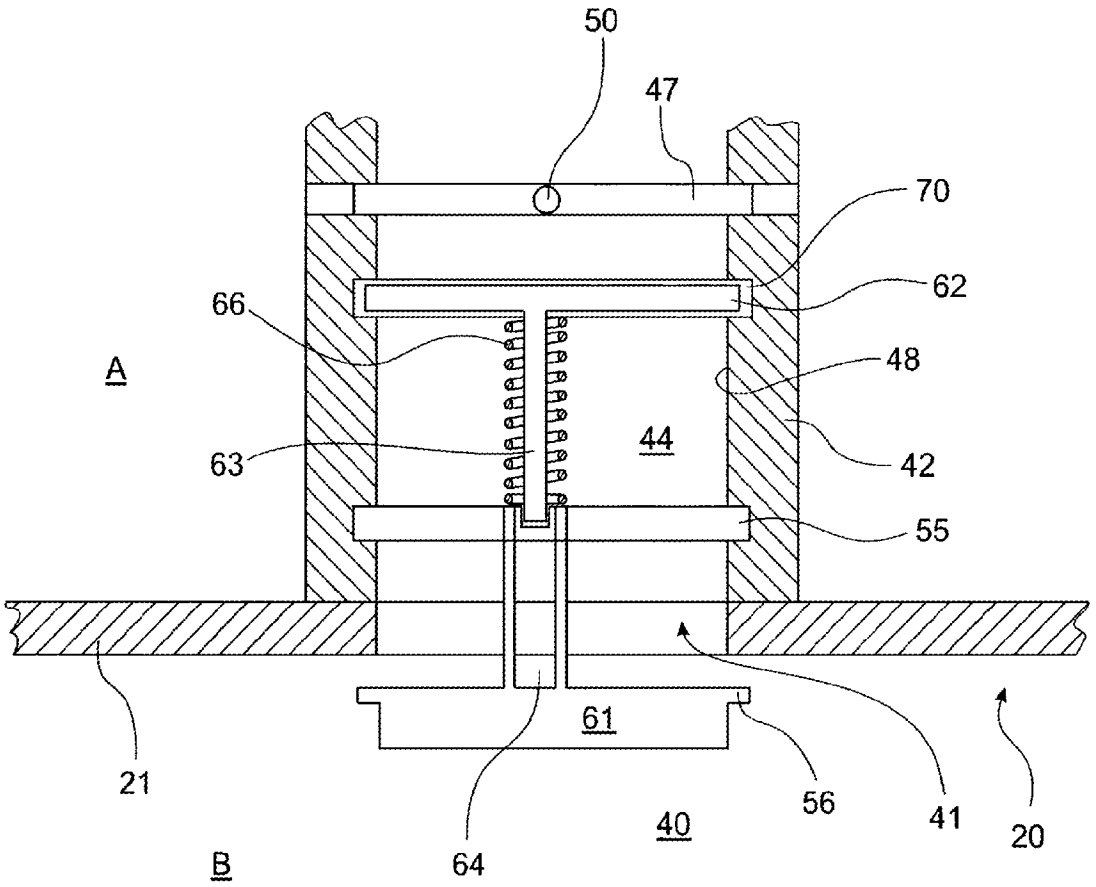
Figure 7A:
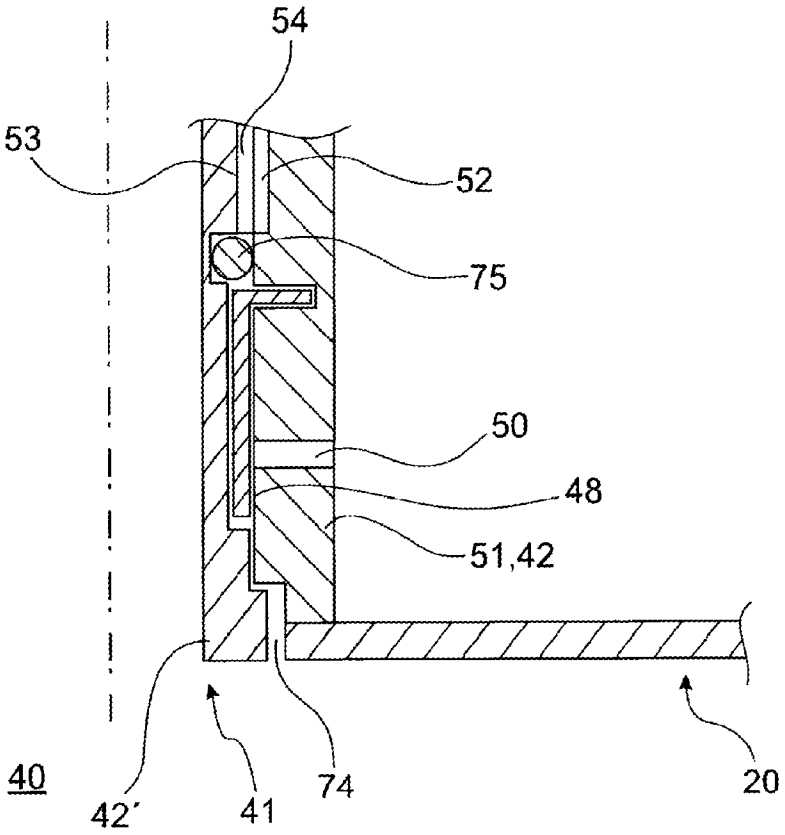
Figure 7B:
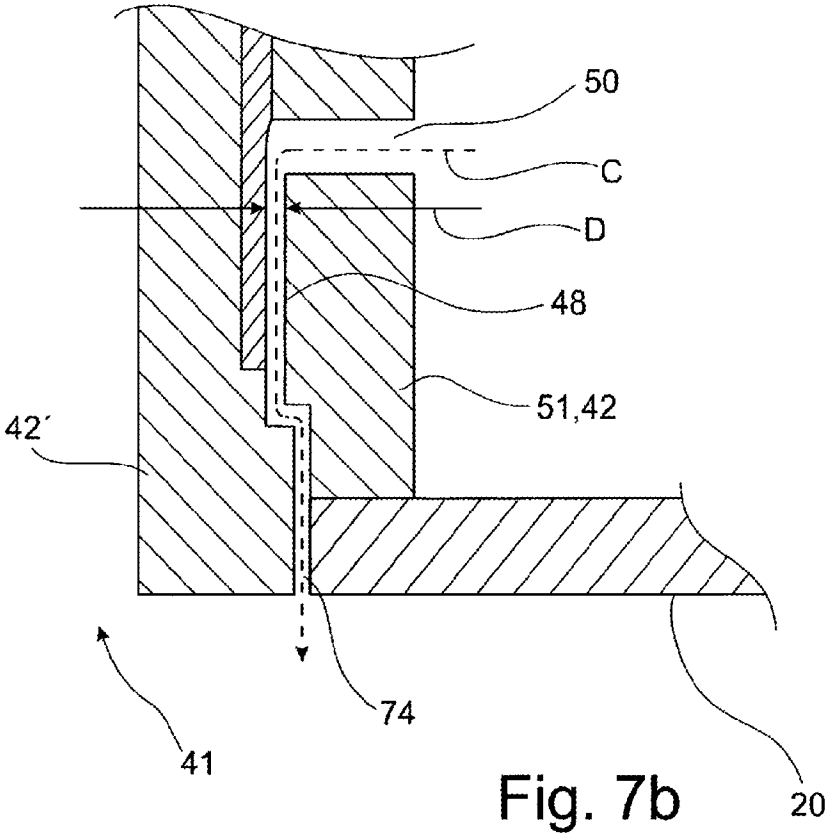
Figure 8:
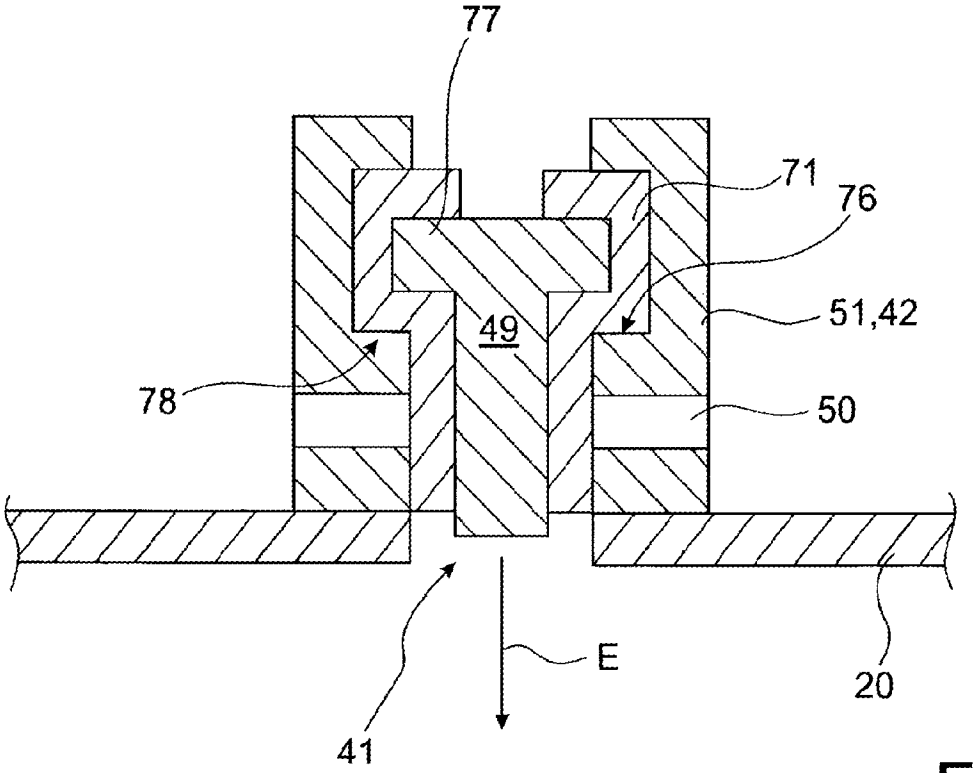

In the following text, the invention will be described in greater detail using drawings, in which:

FIG. 1 shows a three-dimensional illustration of a concrete element according to the invention having a protective element according to the invention, FIG. 2 shows a sectional view with respect to the protective element according to FIG. 1, FIGS. 3*a*-3*d* show outline sketches in sectional views of alternative embodiments with respect to FIG. 2, FIG. 4 shows a detail in a sectional view of a protective element according to the invention of a first embodiment of a drainage element, FIG. 5 shows a detail in a sectional view of a protective element according to the invention of a second embodiment of a drainage element, FIG. 6*a* shows a detail in a sectional view of a protective element according to the invention of a third embodiment of a drainage element, FIG. 6*b* shows a side view of constituent parts of the drainage element with respect to FIG. 6*a*, FIG. 6*c* shows a plan view with respect to FIG. 6*b*, FIG. 6*d* shows a partially sectioned side view of the drainage element with respect to FIG. 6*a* in the mounted state, FIG. 6*e* shows a partially sectioned side view of the drainage element with respect to FIG. 6*a* in the triggered state, FIG. 7*a* shows a detail in a sectional view of a protective element according to the invention of a fourth embodiment of a drainage element, FIG. 7*b* shows an enlarged sectional view with respect to FIG. 7*a*, and FIG. 8 shows a detail in a sectional view of a protective element according to the invention of a fifth embodiment of a drainage element.

A concrete element 10 according to the invention (FIG. 1) is a segment section (segment) of a tunnel lining. The segment section has a convex top side 11 and a bottom side 12 which is arranged so as to lie opposite said top side 11 (concealed by way of a protective element 20 in FIG. 1). The protective element 20 is arranged on the inner side 12 of the concrete element. In this embodiment, the protective element 20 has a bottom section 21 and wall sections 22, 23. A receiving region 29 is provided on said wall sections 22, 23, in which receiving region 29 a seal 30 is arranged. The connection between the seal 30 and the protective element 20 takes place, for example, by way of injection molding.

As an alternative, the concrete element can also have only a protective element 20 with a bottom section 21 (not shown). A seal 30 can be provided but does not have to be provided. If no seal is provided, the joints between the individual protective elements 20 of the concrete elements 10 are welded to one another.

As shown in FIG. 2, the protective element 20 has a bottom section 21, on the outer sides of which wall sections 22, 23 are arranged substantially at right angles, but also in any other desired arrangement. In order to produce a retentive connection between the protective element 20 and the concrete element 10, the inner side of the bottom section 21 has pin elements 17. As an alternative (and not shown), webs can also be arranged parallel to the one outer wall and webs can be arranged with respect to the outer wall which is arranged at a right angle with respect to said outer wall. The webs can be provided, for example, with openings, through which concrete 16 can pass, the concrete therefore producing a particularly satisfactorily retentive connection after hardening.

The seal 30 is arranged in a receiving region 29. The seal 30 consists of an elastic plastic. The seal 30 has a sealing face 31 which comes into contact either with another concrete face or another sealing face 31 of a seal 30 during assembly of the individual concrete elements. The seal 30 has chambers 32 in the interior. During the assembly of the concrete elements 10, the elastic plastic of the seal 30 is deformed, and the chambers 32 are compressed. Holding projections 33 which engage into the plastic of the side wall 22, 23 of the protective element 20 are arranged so as to lie opposite the sealing face 31. Said holding projections 33 and the side walls of the seal 30 which lie close to them are connected during injection molding with the plastic of the protective element and/or are enclosed in a gas-tight manner by said plastic.

A protective element 20, as shown in FIG. 2, can be produced, for example, by way of injection molding. Alternative embodiments are shown in FIGS. 3*a* to 3*d*.

FIGS. 3*a* to 3*d* show alternative embodiments of the protective element 20 with regard to the fact that the protective element 20 or the bottom section and/or the wall section are produced at least partially a second section 28 from prefabricated semifinished products such as webs with projections arranged on them. Here, FIGS. 3*a* to 3*d* show different exemplary types of connection of the second section 28 to a first section 25 which has been produced, for example, using the injection molding method. This connection can take place in the manner of a butt joint (FIGS. 3*a*, 3*d* and 3*c*), or the second section 28 is engaged around by the first section 25 on one side (not shown) or on both sides (FIG. 3*d*). In FIG. 3*b*, the flat element which forms the second section 28 is provided not only as a constituent part of the bottom section 21, but rather also as a wall section 22, 23. The connection in the manner of a butt joint (as shown in FIGS. 3*a*, 3*d* and 3*c*) has surprisingly proven sufficient, in particular in the case of the connection of PE as a flat element and pDCPD as an injection moldable plastic of the first section 25. It is also possible, depending on the requirement made of the protective element, to provide a plurality of flat sections which are possibly made from different materials, which flat sections are then connected to one another via a plurality of first sections 25, via the injection moldable plastic or plurality of different injection moldable plastics. This applies to the bottom section 21, the wall section 22, 23, and also to the roof sections.

FIG. 1 diagrammatically shows a drainage element 40 which is shown in the form of an opening 41 in the protective element 20 in the bottom section 21. As shown diagrammatically in FIGS. 2 to 3*d*, the drainage element 40 has a hollow body 42 which corresponds with the opening 41 at its lower end 43.

Embodiments of the drainage element are shown in FIG. 4 to FIG. 6*e*.

Here, FIG. 4 shows the opening 41 in the protective element 20. A hollow body 42 is arranged on the protective element 20, which hollow body 42 is attached fixedly (in one piece) to the bottom section 21 via a welded seam 43'. The hollow body 42 has an interior space 44 which is defined by way of the wall 45 and a cover element 46. The hollow body 42 can be, for example, an erector dowel, via which handling of the concrete element takes place during installation on site in the tunnel. The wall 45 has a depression 47 which is arranged on the inner wall 48. Hollow body bores 50 are provided in said depression, via which hollow body bores 50 the groundwater passes from the inner side A of the protective element 20 into the interior space 44 of the hollow body 42. From here, it then passes through the opening 41 to the outer side B of the protective element 20. Closure elements 49 are provided in the hollow body bores 50. These can be, for example, elements which are provided movably in the bore 50 and which provide a resistance to the groundwater, however, on account of the friction between the closure element 49 and the bore 50, and are moved out of the bore 50 into the interior space 44 by way of the groundwater only after a limit pressure is reached. As an alternative, the closure element 49 can be connected in one piece to the bore 50, the connection then fracturing if the limit pressure is exceeded.

FIG. 5 shows the opening 41 in the protective element 20. A hollow body 42 is arranged in a corresponding manner on the protective element 20. This can once again be an erector dowel. A connector element 51 with an internal thread section 52 is provided on the protective element 20. The connection of the connector element 51 to the protective element 20 or else of the hollow body 42 to the protective element 20 can take place in the case of a drainage element 40, for example, via welding or adhesive bonding. It is also possible to provide the hollow body 42 in one piece and integrally with the protective element, by the hollow body 42 being produced directly together with the protective element, for example by way of injection molding. In FIG. 5, on its outer wall 53, the hollow body 42 has an external thread section 54 which corresponds to the internal thread section 52. The hollow body 42 is then screwed with its external thread section 54 into the internal thread section 52 of the connector element 51.

A depression 55 which is, for example, of circumferential configuration here is provided on the inner wall 48. A further possible embodiment would be that the depression 55 is provided only in sections on the inner wall 48. The depression 55 serves for receiving at least one section 56 of the closure element 49 in a retentive manner. Here, the closure element 49 is of cover-shaped configuration with a cavity 57. It has a bottom section 58 and a wall 59. An embodiment as a solid body is likewise possible, for example. Via the section 56, the closure element 49 is arranged in the interior space 44 of the hollow body 42 in the depression 55 in such a way that the opening 41 is closed. The closure element 49 is clamped in the depression 55 via the section 56. As an alternative, the closure element can also be screwed via a thread into the opening 41 or into the hollow body 42 or into the openings 50. After a limit pressure is exceeded, the groundwater presses the closure element 49 out of the hollow body 42 or out of the opening 41, with the result that the groundwater can pass to the interior space. The closure element 49 is detached from the drainage element 40 and in the process passes into the tunnel.

FIGS. 6*a* to 6*e* show a further embodiment of a drainage element 40. Here, the opening 41 is once again arranged in the protective element 20. A hollow body 42 is arranged on the protective element in a corresponding manner. This can once again be an erector dowel. A depression 55 which is, for example, of circumferential configuration here is provided on the inner wall 48. Furthermore, a depression 47 is provided with the hollow body bores 50. FIG. 6*a* shows a closure element 60, for example in the form of an O-ring, in the depression 47, which closure element 60 closes the bores 50. The closure can be appropriate, for example, during the connection of the protective element 20 to the concrete 16 during the production of the concrete element 10, in order that no concrete passes into the drainage element 40.

FIG. 6*b* and FIG. 6*c* show one embodiment of the closure element 50. The closure element 60 has a closure section 61 which is connected to an abutment element 62. Here, the abutment element 62 has a rod section 63 which is provided such that it can be moved and displaced with the closure section 61. Here, a blind bore 64 is provided in the closure section, into which blind bore 64 the rod section engages. A rest face 65 is provided in each case on the blind bore or else on the closure section 61 on the one side and on the abutment element 62, on and between which rest faces 65 a spring element 66 is arranged in a prestressed manner, said spring element 66 being arranged around the rod section 6 here. It is advantageous here if the spring element 66 pulls the closure section 61 and the abutment element 62 toward one another, with the result that the groundwater which acts on the closure section 61 has to move the latter away from the abutment element 62. FIG. 6*c* shows a plan view of the abutment element 62 which has a circumferential outer section 67, on which connecting sections 68 for the rod section 63 are provided. Openings 69 are provided between the outer section 67, the connecting sections 68 and the rod section 63, through which openings 69 the groundwater can pass.

Furthermore, a depression 70 is provided circumferentially for receiving the abutment element 62 in the inner wall 48.

FIG. 6*d* shows how the closure element 50 is arranged in the drainage element 40. Here, the abutment element 62 is arranged in the depression 70. Furthermore, the closure section 61 is arranged via sections 56 in the depression 55. At the same time, the spring element 66 pulls the closure section 61 and the abutment element 62 toward one another, and therefore prestresses the closure element 61. The O-ring 60 is removed from the hollow body 42 from the depression 47, and the hollow body bores 42 are free.

FIG. 6*e* shows the triggered or open state of the drainage element 40. The closure element 61 has been released from the depression 55, and has been moved out of the hollow body 42 and through the opening 41 counter to the spring force of the spring element, by way of the groundwater. The opening 41 is released, and the groundwater can flow from the inner side A to the outer side B. The closure element 61 is held by way of the spring element 66, however, and does not fall into the tunnel. During an inspection of the tunnel, after the groundwater pressure has receded, the closure element 61 can then be pressed into the drainage element 40 again, until the section 56 of the closure element 61 engages into the depression 55 again, with the result that the drainage element 40 can be transferred again from an open state into a closed state.

A further embodiment according to the invention is shown in FIGS. 7*a* and 7*b*. The opening 41 is once again provided in the protective element 20, on which opening 41 a drainage element 40 is provided. A hollow body 42 is arranged on the protective element 20 in a corresponding manner, which hollow body 42 is a connector element 51 with an internal thread section 52 here. The connection of the connector element 51 to the protective element 20 can take place, for example, via welding or adhesive bonding in the case of a drainage element 40 of this type. It is also possible to provide the hollow body 42 in one piece and integrally with the protective element, by the hollow body 42 being produced directly together with the protective element, for example by way of injection molding.

In FIG. 7*a*, a further hollow body 42', for example once again an erector dowel or a closure screw, is introduced into the internal thread section 52 of the connector element 51 by way of an external thread section 54 which is attached on its outer wall 53 and corresponds to the internal thread section 52. I The at least one opening 50 is provided in the connector element 51 here. Furthermore, a sealing element 71, for example in the form of a rubber element, is provided which closes the at least one opening 50. Here, the sealing element 71 can be arranged on the hollow body 42', for example by way of adhesive bonding or the like, or is provided on the connector element 51, as shown in FIG. 7. Here, it can also be connected to the connector element 51 by way of adhesive bonding or the like, or it has a connector element 72 which can enter into a retentive connection with the connector element 51. FIG. 7*a* shows the sealing element with a connector element 72 which projects at a right angle and, in the mounted state, protrudes into a depression 73 in the connector element 51 and, as a result, arranges the sealing element 71 on the connector element 51.

A spacing 74 which can be utilized in a channel-like manner for dewatering purposes is situated between the connector element 51 and the hollow body 42'. The spacing is closed by way of the sealing element 71 in the region of the at least one opening 50. A further sealing element 75 is provided above it, for example in the form of an O-ring here, by way of which further sealing element 75 a permanent seal of the spacing 74 between the connector element 51 and the hollow body 42' is achieved, in order to prevent an uncontrolled exit of gases or liquids here.

The prevailing liquid passes through the at least one opening 50 counter to the sealing element 71. The latter is prestressed as it were as a result of its material property. If the pressure becomes greater than the abutment force/spring force of the sealing element 71, the sealing element 71 is deformed and is released from the inner wall 48 (FIG. 7*b*), with the result that a gap D is formed which opens into the channel-like spacing 74. The liquid can then flow out into the interior space in the end direction C through the gap D and the spacing 74.

If the pressure of the prevailing liquid decreases, the sealing element 71 expands again and bears against the inner wall 48 again, with the result that the gap D closes again and the sealing element is closed again in a gas-tight and liquid-tight manner.

A further embodiment according to the invention is shown in FIG. 8. The opening 41 is once again provided in the protective element 20, on which opening 41 a drainage element 40 is provided. A hollow body 42 is arranged on the protective element 20 in a corresponding manner, which hollow body 42 can be a sleeve or a connector element 51. The hollow body 42 has at least one opening 50 in the wall 45 in the interior space 44, for the passage of the prevailing liquid, and a depression 76. An elastic sealing element 71 is provided in the interior space 44 and, in particular, in the depression 76. Furthermore, the sealing element 71 is configured in such a way that it covers and therefore closes the at least one opening 50.

A closure element 49 is provided in a retentive manner in the sealing element 71, preferably in conjunction with the depression. Here, said closure element 49 has by way of example projections 77 which engage into the depression and therefore hold the closure element in the hollow body 42. Dewatering takes place as described above. The prevailing liquid passes through the at least one opening 50 counter to the sealing element 71. The latter is prestressed as it were as a result of its material property. If the pressure becomes greater than the abutment force/spring force of the sealing element 71, the sealing element 71 is deformed and is released from the inner wall 48 (FIG. 7*b*), with the result that a gap D is formed which opens into the channel-like spacing 74. The liquid can then flow out into the interior space in the end direction C through the gap D and the spacing 74. If the pressure of the prevailing liquid decreases, the sealing element 71 expands again and bears against the inner wall 48 again, with the result that the gap D closes again and the sealing element is closed again in a gas-tight and liquid-tight manner.

In addition, the closure element is pressed downward toward the interior space in the arrow direction E. As a result, an additional sealing action is brought about within the depression in the region of the horizontal sections 78 of the depression 76. If the liquid in the concrete element 10 increases further and the pressure increases further beyond a magnitude, such that the prevailing liquid cannot be discharged via the opening 50, then the closure element 49 can be pressed out of the sealing element 71 and the depression 76 and then out of the hollow body 42 into the interior space in the arrow direction E, in order to make a more pronounced liquid exit possible and in order to prevent damage of the protective element 20.

LIST OF DESIGNATIONS

| | | | |
|---|---|---|---|
| 10 | Concrete element | 54 | External thread section |
| 11 | Top side | 55 | Depression |
| 12 | Bottom side | 56 | Section |
| 16 | Concrete | 57 | Cavity |
| 17 | Pin element | 58 | Bottom section |
| 20 | Protective element | 59 | Wall |
| 21 | Bottom section | 60 | Closure element |
| 22 | Wall section | 61 | Closure section |
| 23 | Wall section | 62 | Abutment |
| 25 | Section | 63 | Rod section |
| 28 | Section | 64 | Blind bore |
| 29 | Receiving region | 65 | Rest face |
| 30 | Seal | 66 | Spring element |
| 31 | Sealing face | 67 | Outer section |
| 32 | Chamber | 68 | Connecting section |
| 40 | Drainage element | 69 | Opening |
| 41 | Opening | 70 | Depression |
| 42 | Hollow body | 71 | Sealing element |
| 42' | Hollow body | 72 | Connector element |
| 43 | Lower end | 73 | Depression |
| 43' | Welded seam | 74 | Spacing |
| 44 | Interior space | 75 | Sealing element |
| 45 | Wall | 76 | Depression |
| 46 | Cover element | 77 | Projection |
| 47 | Depression | 78 | Horizontal section |
| 48 | Inner wall | A | Inner side |
| 49 | Closure element | B | Outer side |
| 50 | Hollow body bore | C | Outflow direction |
| 51 | Connector elements | D | Gap |
| 52 | Internal thread section | E | Outflow direction |
| 53 | Outer wall | | |

The invention claimed is:

1. A protective element for connecting to a concrete element of a tunnel lining, comprising a protective section including at least one plastic material comprising;

a first side facing the concrete element comprising at least one connecting element configured to establish a retentive connection of the protective section to the concrete element;

at least one drainage element through which a liquid can pass from the first side of the protective section toward the opposite side of the protective section which faces away from the concrete element, and;

at least one of a spring element or an elastic element for producing the prestress, wherein the drainage element comprises a closure element configured to close the drainage element with respect to the opposite side of the protective section, wherein the closure element is prestressed into the drainage element.

2. The protective element as claimed in claim 1, wherein the drainage element comprises a receptacle for the closure element.

3. The protective element as claimed in claim 1, wherein the protective element comprises at least one seal gas-tight and liquid-tight connected in one piece to the protective section.

4. A protective element for connecting to a concrete element of a tunnel lining, comprising a protective section including at least one plastic material comprising;

a first side facing the concrete element comprising at least one connecting element configured to establish a retentive connection of the protective section to the concrete element;

at least one drainage element through which a liquid can pass from the first side of the protective section toward the opposite side of the protective section which faces away from the concrete element;

wherein the drainage element comprises at least one opening in the protective element, wherein the drainage element comprising a hollow body corresponding to the at least one opening, wherein the hollow body comprises at least one hollow body opening in a wall of the hollow body, through which the liquid can pass from the first side into the hollow body, wherein a closure body is disposed at least one of in or in front of the at least one hollow body opening.

5. The protective element as claimed in claim 4, wherein the one hollow body is at least one of a sleeve or an erector dowel.

6. The protective element as claimed in claim 4, wherein the protective element comprises at least one seal gas-tight and liquid-tight connected in one piece to the protective section.

7. A concrete element of a tunnel lining having a convex outer surface and an opposite inner surface, comprising a protective element connected to the concrete element via at least one connecting element to the inner surface of the concrete element, comprising a protective section including at least one plastic material comprising;

a first side facing the concrete element comprising at least one connecting element configured to establish a retentive connection of the protective section to the concrete element;

at least one drainage element through which a liquid can pass from the first side of the protective section toward the opposite side of the protective section which faces away from the concrete element.

8. The concrete element as claimed in claim 7 wherein the drainage element comprises a closure element configured to close the drainage element with respect to the opposite side of the protective section.

9. The concrete element as claimed in claim 8, wherein the drainage element comprises a receptacle for the closure element.

10. The concrete element as claimed in claim 8, wherein the closure element is prestressed into the drainage element.

11. The concrete element as claimed in claim 7, wherein the drainage element comprises at least one opening in the protective element.

12. The concrete element as claimed in claim 11, wherein the drainage element comprises a hollow body corresponding to the at least one opening.

13. The concrete element as claimed in claim 12, wherein the one hollow body is at least one of a sleeve or an erector dowel.

14. The concrete element as claimed in claim 11, wherein the at least one opening is normally closed and is configured to open when a limit pressure is exceeded.

15. The concrete element as claimed in claim 7, comprising at least one hollow body opening in a wall of the hollow body, through which the liquid can pass from the first side into the hollow body.

16. The concrete element as claimed in claim 15, comprising a closure body at least one of in or in front of the at least one hollow body opening.

17. The concrete element as claimed in claim 15, wherein the hollow body opening is configured to open when a limit pressure is exceeded.

18. The protective element as claimed in claim 17, wherein the protective element comprises at least one seal gas-tight and liquid-tight connected in one piece to the protective section.

19. The concrete element as claimed in claim 7, wherein the protective section comprises at least one of at least one bottom section or has at least one bottom section and at least one wall section.

20. The concrete element as claimed in claim 19, wherein the at least one drainage element is disposed on at least one of on the at least one bottom section or on the at least one wall section.

21. The concrete element as claimed in claim 7, wherein the protective element comprises at least one seal gas-tight and liquid-tight connected in one piece to the protective section.

22. A protective element for connecting to a concrete element of a tunnel lining, comprising a protective section including at least one plastic material comprising;

a first side facing the concrete element comprising at least one connecting element configured to establish a retentive connection of the protective section to the concrete element;

at least one drainage element through which a liquid can pass from the first side of the protective section toward the opposite side of the protective section which faces away from the concrete element;

wherein the drainage element comprises at least one opening in the protective element, wherein the drainage element comprising a hollow body corresponding to the at least one opening, wherein the hollow body comprises at least one hollow body opening in a wall of the hollow body, through which the liquid can pass from the first side into the hollow body, wherein the hollow body opening is configured to open when a limit pressure is exceeded.

23. The protective element as claimed in claim 22, wherein the one hollow body is at least one of a sleeve or an erector dowel.

* * * * *